US009777515B2

(12) United States Patent
Barmscheidt

(10) Patent No.: US 9,777,515 B2
(45) Date of Patent: Oct. 3, 2017

(54) MOTOR-VEHICLE DOOR LOCK

(71) Applicant: Kiekert Aktiengesellschaft, Heiligenhaus (DE)

(72) Inventor: Christian Barmscheidt, Duisburg (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 539 days.

(21) Appl. No.: 14/381,725

(22) PCT Filed: Feb. 26, 2013

(86) PCT No.: PCT/DE2013/000102
§ 371 (c)(1),
(2) Date: Aug. 28, 2014

(87) PCT Pub. No.: WO2013/127381
PCT Pub. Date: Sep. 6, 2013

(65) Prior Publication Data

US 2015/0042110 A1 Feb. 12, 2015

(30) Foreign Application Priority Data

Feb. 28, 2012 (DE) ..... 20 2012 001 961 U

(51) Int. Cl.
*E05C 3/06* (2006.01)
*E05B 81/00* (2014.01)
(Continued)

(52) U.S. Cl.
CPC ..... *E05B 81/00* (2013.01); *E05B 47/0012* (2013.01); *E05B 81/06* (2013.01);
(Continued)

(58) Field of Classification Search
CPC ..... Y10T 292/307; Y10T 292/308; Y10T 292/1082; E05B 17/0045; E05B 77/36
See application file for complete search history.

(56) References Cited

U.S. PATENT DOCUMENTS 5,020,838 A * 6/1991 Fukumoto ..... E05B 81/14 292/201
5,035,454 A * 7/1991 Fukumoto ..... E05B 81/06 292/201
(Continued)

FOREIGN PATENT DOCUMENTS

| | | | |
|---|---|---|---|
| DE | 100 00 708 | A1 | 7/2001 |
| EP | 2 182 148 | A2 | 5/2010 |
| FR | 2 775 717 | A1 | 9/1999 |
| WO | 00/79079 | A1 | 12/2000 |

OTHER PUBLICATIONS

International Search Report and translation for corresponding patent application No. PCT/DE2013/000102 dated Feb. 4, 2014.

*Primary Examiner* — Carlos Lugo
(74) *Attorney, Agent, or Firm* — Renner, Otto, Boisselle & Sklar, LLP

(57) ABSTRACT

The invention relates to a motor vehicle door lock comprising a locking mechanism, also at least one locking element (3), an electric drive (5, 6, 7) for the locking mechanism, and at least two stops (20, 21, 22, 27) for the electric drive (5, 6, 7) and/or the locking element (3), wherein one of the stops (20, 21) is associated with the locking element (3) and the other stop (22, 27) is associated with the electric drive (5, 6, 7) and both stops (20, 21, 22, 27) are arranged on a common stop contour (23).

13 Claims, 4 Drawing Sheets

(51) Int. Cl.

| | |
|---|---|
| ***E05B 81/06*** | (2014.01) |
| ***E05B 81/14*** | (2014.01) |
| ***E05B 81/20*** | (2014.01) |
| ***E05B 81/42*** | (2014.01) |
| ***E05B 47/00*** | (2006.01) |
| *E05C 3/16* | (2006.01) |
| *E05B 77/36* | (2014.01) |
| *E05B 17/00* | (2006.01) |

(52) U.S. Cl.

CPC ..... *E05B 81/14* (2013.01); *E05B 81/20* (2013.01); *E05B 81/42* (2013.01); *E05B 17/0045* (2013.01); *E05B 77/36* (2013.01); *Y10T 292/1082* (2015.04); *Y10T 292/307* (2015.04); *Y10T 292/308* (2015.04); *Y10T 292/57* (2015.04)

(56) References Cited

U.S. PATENT DOCUMENTS

| | | | | | |
|---|---|---|---|---|---|
| 5,309,745 | A * | 5/1994 | Ursel | E05B 81/06 | 292/201 |
| 5,938,252 | A * | 8/1999 | Uemura | E05B 81/14 | 292/201 |
| 5,938,253 | A * | 8/1999 | Szablewski | E05B 81/14 | 292/201 |
| 6,279,361 | B1 * | 8/2001 | Baukholt | E05B 81/14 | 292/201 |
| 6,474,704 | B1 * | 11/2002 | Rathmann | E05B 81/14 | 292/201 |
| 9,151,092 | B2 * | 10/2015 | Scholz | E05B 85/26 | |
| 2004/0232707 | A1 * | 11/2004 | Kachouh | E05B 81/14 | 292/216 |
| 2015/0084352 | A1 * | 3/2015 | Barmscheidt | E05B 81/15 | 292/201 |

* cited by examiner

MOTOR-VEHICLE DOOR LOCK

The invention relates to a motor vehicle door lock comprising a locking mechanism and at least one lock element as well as an electric drive for the locking mechanism and at least two stops for the electric drive and/or the lock element.

Numerous types of stops for individual elements of a motor vehicle door lock are known. EP 0 336 034 A2 discloses, for instance, a damping stop for a locking pin engaging in a locking mechanism. The locking pin is fixed in the infeed section with the aid of the stop or damping element to reduce noise.

In addition, EP 1 620 616 B1 discloses a motor vehicle door lock in which the rotary latch is provided with a stop rib. The stop rib is part of a thermoplastic casing.

Utility patent DE 87 15 923 U1 also discloses a rubber or plastic casing for a rotary latch. The casing also encloses a bearing structure of the rotary latch and glides on an associated bearing pin and against other bearing points. In this way, unwanted noises generated by metal coming into contact with metal, are to be eliminated.

The generic state of the art of DE 198 28 040 B4 discloses a powered closing device for doors, tailbacks, soft-tops or roofs of vehicles and in particular passenger cars. The closing device contains a rotary latch and a pawl detachably locking the rotary latch. Also an actuator with a control disk is provided. The actuator acts through the control disk on the rotary latch and the pawl in the sense of an opening and closing operation. The rotary latch contains a pivotable stop element and the pawl also contains a pivotable stop element. Both stop elements cooperate with the control disk during opening and closing. In this way, a simple construction and easy installation is to be provided by such a powered closing arrangement.

Prior art has generally proven to be successful as regards the use of stops for the electric drive and/or an additional lock element. However, separate stops are, in most cases, used for the electric drive on one hand and the lock element, on the other hand, as the respective components are in most cases arranged away from each other inside a lock housing. There is, however, a requirement for providing both the lock element and the electric drive with stops of a similar design. This is the task of the invention.

The invention is based on the technical problem of further developing a motor vehicle door lock of the aforementioned design in such a way that the lock element and the electric drive are provided with stops of a similar design, whilst taking into consideration a simple and cost-effective production.

In order to solve this technical problem, a generic motor vehicle door lock of the invention is characterized by one of the two stops being assigned to the lock element and the other stop to the electric drive and both stops being arranged on a common stop contour.

This means that said stop contour contains both stops so that the function and the design of both stops can be similar by selecting the material for the stop contour. The use of a common stop contour also ensures that both stops are arranged on a common and matching component, which can be easily produced and installed.

In order to achieve this, two stops are assigned to the lock element to restrict its movements. In this case, the stop contour thus contains both stops for the lock element as well as also the stop for the electric drive.

The lock element is normally designed as a pivoted lever. As a result, the design can be such that the stops assigned to the two lock elements or pivoted lever belong to different functional positions of the lock element or pivoted lever. In the actual case, the lock element is normally designed as a locking lever.

The two stops for the lock element or the locking lever on the stop contour correspond in this case to the "locked" functional position on one hand and the "unlocked" functional position of the locking lever on the other hand. In contrast, the stop for the electric drive is in most cases an end stop. In most cases this end stop is used once the electric drive has reached its final position. Naturally also two stops can be provided for the electric drive, for instance a starting and an end stop.

The electric drive is typically a drive, providing the so-called electric opening. This means that the electric drive ensures that, as part of the locking mechanism, a pawl is lifted off the associated rotary latch. As a result, the rotary latch can open with the aid of a spring. In principle, the electric drive can naturally also carry out other functions inside the motor vehicle door lock, such as a central locking drive.

In the embodiment, the electric drive does, however, ensure in normal operation that the locking mechanism is impinged upon for electric opening. The electric drive also ensures in at least the so-called emergency operation that mechanical opening of the locking mechanism is possible. This functioning is also referred to as "temporary crash redundancy" (TCR). This means that, for instance, in case of an accident, the electric drive ensures during the prevailing emergency operation that the locking mechanism can be mechanically opened and independently of the electric drive. This is of course only an example and applies for the intended use described above.

In detail, the electric drive typically comprises at least one electric motor, a worm gear and a driven wheel gear meshing with the worm gear. As a result, the invention also allows the use of several gear stages. The driven wheel gear cooperates for instance with a triggering lever via an opening contour, lifting the pawl, as described, off the rotary latch during electric opening. At the end of this movement, the electric drive moves against the end stop. For this purpose, the driven wheel gear contains in most cases a respective stop or counter stop.

The stop contour containing, on one hand, the stops for the locking lever and, on the other hand, for the electric drive or electric opening drive, is generally designed as a single component with stops formed thereon. It has proven to be particularly advantageous for the stop contour to be designed as a plastic component and, in particular as an injection moulded plastic component, as such an injection moulded plastic component is cost-effectively produced in a single operation.

The stop contour also regularly contains cavities. It has indeed proven to be advantageous for cavities to be assigned to the stops for damping. This allows, for instance, the locking lever to move against the one stop or the other stop with a relatively "hard" impact, without the fear of any damage or unwanted noise being generated in this context. Instead, the cavity assigned into the respective stop ensures that the stop is not subjected to a deformation caused by the material, but can also structurally change its form by the stop wholly or partially deflecting in the cavity behind it. Irrespective of this, the one or several cavities in the stop contour reduce the overall weight of the stop contour to a minimum without impairing its functionality in any way.

The stop contour is typically made of plastic, providing the required elasticity per se and also providing an excellent noise reduction when coming into contact with a metal part. In particular elastomer and thermoplastics such as PUR (Polyurethane) have shown to be particular advantageous, especially as such plastic also offers the required temperature stability. The maximum operating temperature of PUR is, for instance, significantly higher than 100° C. so that such plastic is predestined for the use in motor vehicle door locks.

The stop contour as such can be arch-shaped and can be thicker at the ends. The thicker sections are typically formed in such a way that one or more stops are provided with an associated cavity in this area. The stop contour is generally mechanically connected to a lock housing and, in particular, a lock cover. As such a lock cover is an injection-moulded plastic part—like the stop contour—it is recommended for an advantageous design for the stop contour to form a single part with the lock housing or lock cover.

In this context, a two-component injection-moulding process can be used, in which the lock housing or lock cover is, for instance, made of PE (Polyethylene) or PP (Polypropylene), whilst the stop contour is made of the aforementioned PUR (Polyurethane). The lock cover and the stop contour can, in any case be produced in one operation and as a single part by injection moulding. Where at this point different plastic materials are used for the lock cover on one hand and the stop contour, on the other hand, a two-component injection moulding process is used.

As a result, a motor vehicle door lock is produced, containing several stops for the electric drive on one hand and a lock element or a pivoted lever inside the associated lock housing, on the other hand. The two stops are supported or provided by a common stop contour, which in turn is generally connected to the lock housing/lock cover. The lock actually generally comprises a lock case supporting, carrying and accommodating the individual lock element which is, for instance, made of metal and the lock housing/cover, sealing the lock case, which is made of plastic.

As the stop contour contains basically all stops required inside the motor vehicle door lock, theses stops are directly provided as soon as the lock housing/lock cover is combined with the lock case, as for this purpose the stop contour is arranged or connected to the lock housing/lock cover. In order to achieve a particularly cost effective production, the lock housing/lock cover and the stop contour can form an overall single-piece component, as described. These are the main advantages of the invention.

Below, the invention is explained in detail with reference to a drawing showing only one embodiment, in which.

Figure 1:
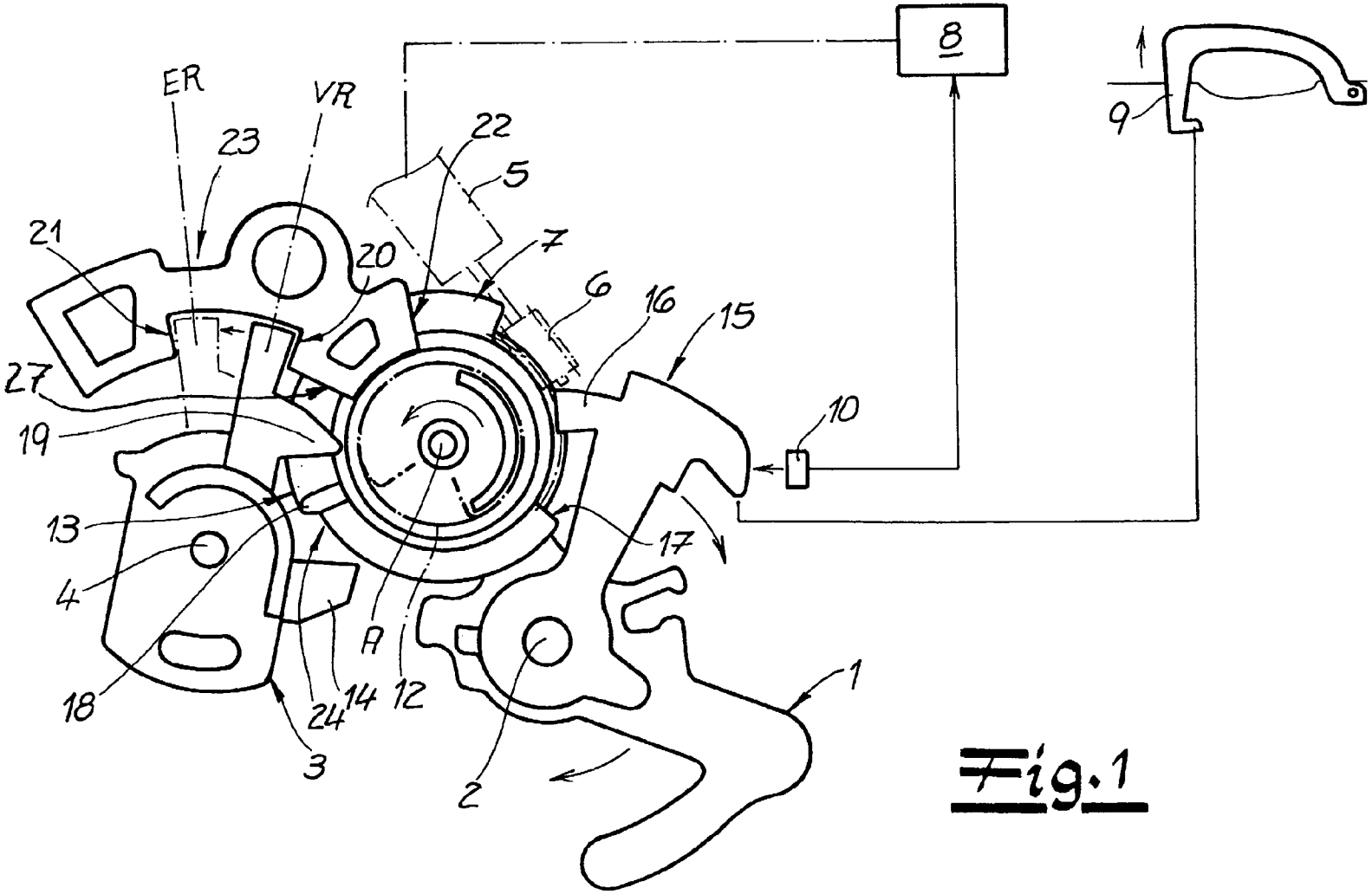
FIG. 1 shows a front view of a motor vehicle door lock of the invention.

The figures show a motor vehicle door lock containing a locking mechanism—not expressly shown. The locking mechanism comprises, as usual, a rotary latch and a pawl. The pawl is impinged upon by a triggering lever 1, mounted in a lock housing or lock case and pivotable around an axis 2. As soon as the triggering lever 1 carries out or can carry out a clockwise rotation around its axis 2 as indicated in FIG. 1, the triggering lever 1 is able to lift the pawl off the rotary latch. The functionality is similar to that disclosed in more detail in EP 1 320 652 B1.

The figure also shows a lock element or a locking lever 3, pivotally mounted around an axis 4. As shown in FIG. 1, the locking lever 3 assumes its "locked" (VR) position. FIG. 1 also shows the "unlocked" (ER) position of the locking lever 3.

The general design furthermore includes an electric drive 5, 6, 7. The electric drive 5, 6, 7 comprises an electric motor 5, a worm gear 6 impinged upon by an electric motor 5 and finally a driven wheel gear 7, meshing with the worm gear 6. The driven wheel gear 7 is able to carry out the pivoting movements around its axis A and in relation to FIG. 1 in counter-clockwise direction or in a first drive direction and in clockwise direction corresponding to a second drive direction.

Figure 2:
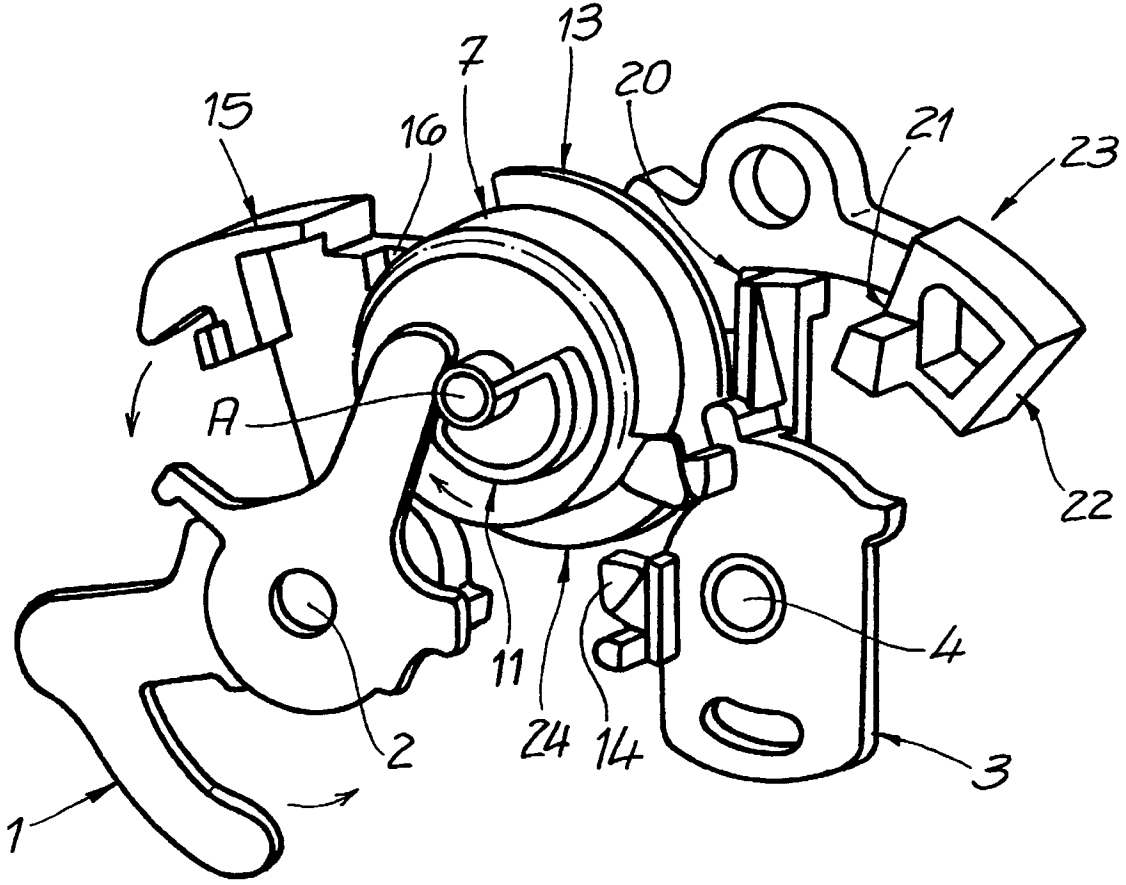
FIG. 2 shows a rear view of the object of FIG. 1.
Figure 3:
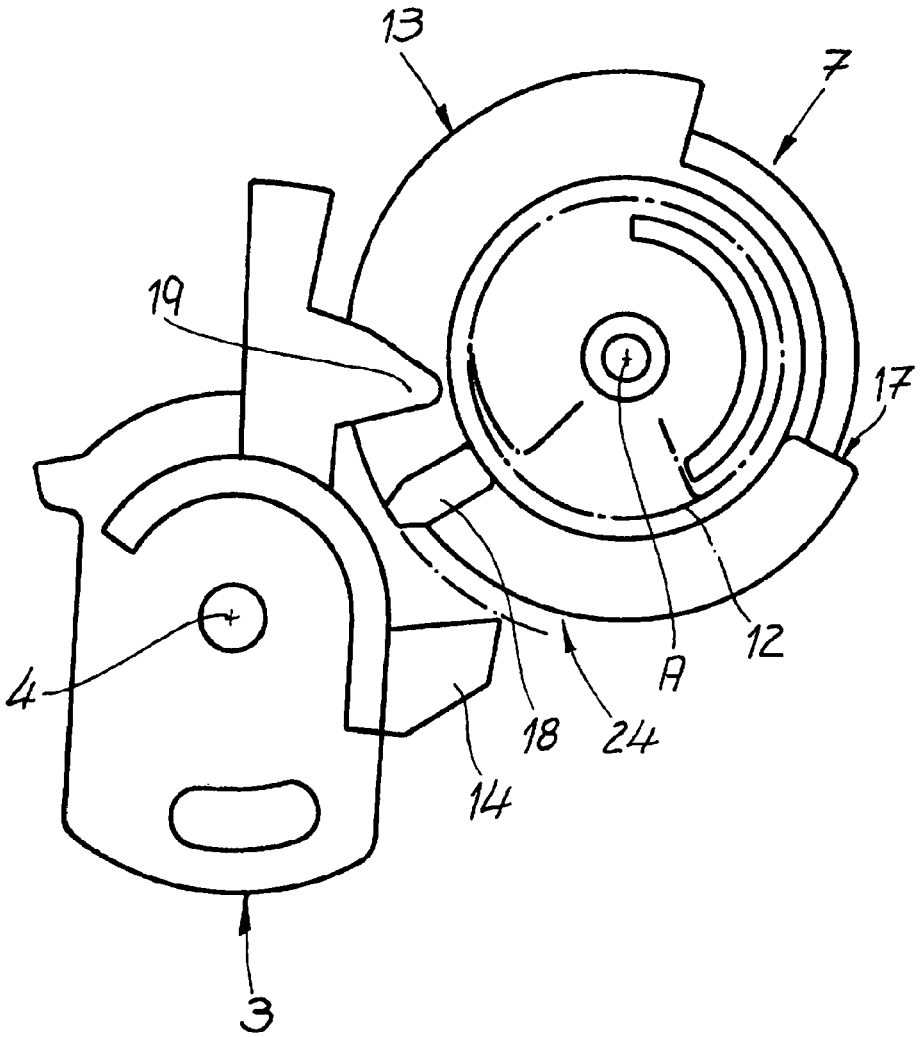
FIG. 3 shows an enlarged view of the driven wheel gear and the locking lever and FIG. 4 shows an enlarged and partly perspective view of the motor vehicle door lock of FIG. 1.

During normal operation, a handle 9 and a signal generator 10 ensure that the opening movement on the handle 9 is registered by the signal generator 10 and is transmitted to a control unit 8. The control unit 8 interprets a respective impinging on the signal generator 10 as an associated motor vehicle door to be opened. The control unit 8 thus ensures that the electric motor 5 is energized and in such a way that the driven wheel gear 7 carries out a counter-clockwise movement as indicated by an arrow in the diagram of FIG. 1. This counter-clockwise movement in the normal operation of the locking mechanism and during electric opening with the assistance of the electric drive 5, 6, 7, corresponds to an opening contour 11 or an opening cam 11 impinging upon the triggering lever 1 and pivoting it around its axis of rotation 2 in counter-clockwise direction as indicated by the arrow. As a result, the triggering lever 1 ensures that the pawl is lifted off the rotary latch which in turn opens with the help of a spring (see FIGS. 1 and 2).

In a further embodiment—not shown—the directions of rotation for the respective functions can also be changed.

The opening contour or the opening cam 7 is assigned to the electric drive 5, 6, 7. In the embodiment, the opening contour or the opening cam 11 are located on the driven wheel gear 7.

An additional electric drive 5, 6, 7 assigned to the return spring 12 ensures that the electric drive 5, 6, 7 is returned into a neutral position after impinging upon the triggering lever 1. For this purpose, said spring 12 is designed as a centre/zero spring in the embodiment.

During the described electric opening, a blocking contour 13 on the driven wheel gear 7 ensures that the locking lever 3 retains at all times the "locked" position (VR) shown and assumed in FIG. 1. The blocking contour 13 cooperates with a projection 14 on the respective locking lever 3 during the described electric opening process. In this way, the electric drive 5, 6, 7 or its driven wheel gear 7 contains a release lock which ensures, as described, during electric opening of the locking lever 3 that it is retained in its "locked" (VR) position. To achieve this, the release lock or the already described blocking contour 13 is provided on the driven wheel gear 7 as part of the electric drive 5, 6, 7.

The handle 9 does not only act on the signal generator 10 but also impinges upon a blocking lever 15 also shown. This blocking lever 15 is mounted on the same axis as the triggering lever 1 around a common axis of rotation 2. As soon as the handle 9 is actuated by an operator in the opening sense, the blocking lever 15 pivots around axis 2 in counter-clockwise direction. As a result, a blocking projection 16 on the blocking lever 15 is disengaged from the electric drive 5, 6, 7 or its driven wheel gear 7.

If the handle 9 and thus the blocking lever 15 is, however, not impinged, the blocking projection 16 remains engaged with the electric drive 5, 6, 7 and ensures during a potential incorrect energizing of the electric drive 5, 6, 7 that it is decelerated in the counter-clockwise movement, as during this process a stop 17 moves against the blocking projection 16. The pivoting movement carried out by the driven wheel gear 7 up to this point is designed in such a way, that an incorrect energizing of the locking mechanism cannot cause the opening of the locking mechanism. The stop 17 and the blocking projection 16 on the blocking lever 15 also ensure that the pivoting movement of the electric drive 5, 6, 7, for moving the locking lever 3 from its unlocked to its locked position, is limited.

If the locking lever 3 is, for instance in its "unlocked" (ER) position, as shown in the diagram of FIG. 1, impinging upon the electric drive 5, 6, 7 or upon its driven wheel gear 7 in counter-clockwise direction this causes a locking contour 18 on the driven wheel gear 7 to engage with the blocking projection 14 of the locking lever 3, pivoting said lever from the "unlocked" position (VR) around axis 4 into the "locked" position (VR) in counter-clockwise direction. This pivoting movement of the driven wheel gear 7 in counter-clockwise direction is restricted by the blocking stop 17 on the driven wheel gear 7 moving against the blocking projection 16 of the blocking lever 15.

Immediately after switching from normal to emergency operation, the emergency operation ensures that the control unit 8 and the electric motor 5 no longer causes the driven wheel gear 7 to carry out a counter-clockwise movement (first drive direction) but is instead acted upon in counter-clockwise direction (second drive direction). As a result, the locking or unlocking contour 18 on the driven wheel gear 7 engages with an unlocking projection 19 on the locking lever 3. As during this process the driven wheel gear 7 is pivoted around its axis A in counter-clockwise direction, the cooperation between the unlocking or locking projection 19 and the unlocking contour 18 ensures that the locking lever 3 is pivoted around its axis 4 in counter-clockwise direction.

During this process the locking lever 3 leaves a stop 20 and moves against a stop 21. At the same time, the locking lever 3 moves from its "locked" into its "unlocked" position. Both stops 20, 21 are part of a stop contour 23, also containing a stop 22. This stop or end stop 22 is used as soon as the electric drive 5, 6, 7 moves with its stop 17 against said stop during electric opening. This is possible, as during such electric opening the blocking lever 15 is pivoted away with the help of the handle 9, allowing the stop 17 on the driven wheel gear 7 to pass the blocking lever 15. The stop contour 27 is used when, during emergency operation, the unlocking contour 18 on the driven wheel gear 7 has moved the locking lever 3 into the "unlocked" position, as end stop for the emergency operation.

It is also apparent that the driven wheel gear 7 contains a recess 24. This recess 24 ensures that when the electric opening process is already initiated, a repeat actuation of the handle 9 or a release and repeat actuation of the handle 9 can be processed by the signal generator 10 assigned to the blocking lever 15. —The overall stop contour 23 can be made of elastomer or thermoplastic and can be connected to the motor vehicle door lock housing.

Figure 4:
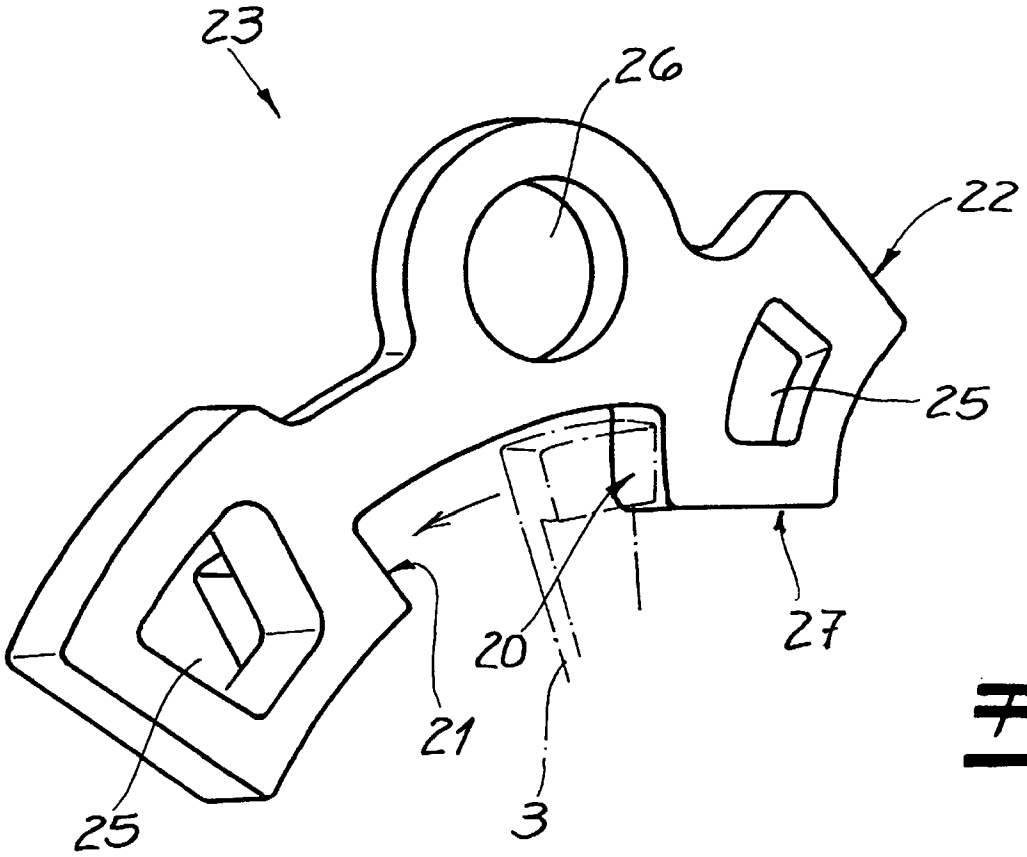

FIG. 4 shows an enlarged view of the stop contour 23, with the individual stops 20, 21, 22 and 27. The two stops 20, 21 correspond to the locking lever 3, whilst stop 22 cooperates with the electric drive 5, 6, 7 and is thus designed as an end stop 22. The stop contour 23 is designed as a single plastic component with stops 20, 21, 22 and 27 contained thereon. The stop contour 23 is actually an injection-moulded part.

According to the invention, the stop contour 23 can also be designed as a two-component injection moulding together with the lock housing/lock cover.

In particular from the enlarged representation shown in FIG. 4, it is apparent that cavities 25 are in each case assigned to stops 20, 21 and 22 for damping. This ensures that the stops 20, 21 and 22 can not only absorb any deformations due to their material characteristics but are also structurally able to absorb deformation. During this process, the respective stop 20, 21 and 22 is at least partially displaced in the direction of the force into the cavity 25 behind the stop. The direction of the force is stipulated by the element moving against the respective stop 20, 21 and 22 and other elements to be decelerated. These are, on one hand, the locking lever 3 in relation to the two stops 20 and 21 and, on the other hand, stop 17 on the driven wheel gearwheel gear 7 of the electric drive 5, 6, 7.

In order to achieve a flexible damping based on this application, the cavities 25 can be made of materials with different hardnesses or can be completely eliminated.

The overall stop contour 23 is connected to a lock cover not expressly shown in the figures. In the view shown in FIG. 4 or the front view shown in FIG. 1, the lock cover is located above the plane of projection. The stop contour 23 can, in fact, be designed as a single piece with the lock cover. This can typically be achieved using a two-component injection moulding process.

Another, non-damping cavity 26 of the stop contour 23 ensures that the overall weight of the stop contour 23 and also the used material is reduced to a minimum. It is also apparent and, in particular, from FIG. 4, that the stop contour 23 is arch-shaped, as a whole, with thicker sections at its ends. The thicker sections are provided by the cavities 25 and the associated stops 20 or 21 and 22. The thicker sections are square and connected to the end of the stop contour 23. The thicker sections are rectangular frames enclosing the respective cavities 25. The individual or several framework legs act as stops 20, 21, 22.

In FIG. 4 the left thicker section is actually designed as a stop 21 with one framework leg. In contrast, the right thicker section in FIG. 4 contains two stops 20, 22, practically diametrically arranged in relation to the framework legs facing the centre cavity 25.

The invention claimed is:

1. A motor vehicle door lock comprising:

a locking mechanism;

at least one lock element;

an electric drive for the locking mechanism that includes an electric motor and at least one gear; and a stop part having at least two stops arranged on a common contour of the stop part, wherein a first stop interacts with an element of the at least one lock element and a second stop interacts with the at least one gear of the electric drive, wherein the first stop includes two stop sides that interact with the lock element to restrict movement of the lock element.

2. The motor vehicle door lock according to claim 1, wherein the lock element is a pivoted lever.

3. The motor vehicle door lock according to claim 1, wherein the two stop sides belong to different functional positions.

4. The motor vehicle door lock according to claim 1, wherein the second stop for the electric drive is an end stop.

5. The motor vehicle door lock according to claim 1, wherein during normal operation the electric drive impinges upon the locking mechanism for electric opening and also provides a mechanical opening of the locking mechanism at least during emergency operation.

6. The motor vehicle door lock according to claim 1, wherein the electric drive comprises at least one electric motor, a worm gear driven by said motor and a driven wheel gear meshing with the worm gear.

7. The motor vehicle door lock according to claim 1, wherein the stop part is a unitary component with a plurality of stops formed thereon.

8. The motor vehicle door lock according to claim 1, wherein the stop part is an injection-moulded part.

9. The motor vehicle door lock according to claim 1, wherein cavities are assigned to each stop for damping.

10. The motor vehicle door lock according to claim 1, wherein the stop part is formed of an elastic material.

11. The motor vehicle door lock according to claim 1, wherein the stop part is arch-shaped with thicker sections at its ends.

12. The motor vehicle door lock according to claim 1, wherein the stop part is mechanically connected to or forms a single piece with a lock cover.

13. A motor vehicle door lock comprising:

a locking mechanism;

at least one lock element;

an electric drive for the locking mechanism that includes an electric motor and at least one gear; and a stop part having at least two stops arranged on a common contour of the stop part, wherein a first stop interacts with an element of the at least one lock element and a second stop interacts with the at least one gear of the electric drive;

wherein the lock element is a locking lever and the locking lever includes two stop sides for restricting movement of the lock between a locked or unlocked functional position.

* * * * *